US007513542B2

(12) United States Patent
Schumm

(10) Patent No.: US 7,513,542 B2
(45) Date of Patent: Apr. 7, 2009

(54) DOOR WITH INTEGRATED STOPPER

(76) Inventor: Hermann Schumm, Kreuzweg 8, 74599 Wallhausen-Michelbach (DE)

( * ) Notice: Subject to any disclaimer, the term of this patent is extended or adjusted under 35 U.S.C. 154(b) by 0 days.

(21) Appl. No.: 11/601,379

(22) Filed: Nov. 17, 2006

(65) Prior Publication Data

US 2008/0115319 A1 May 22, 2008

(51) Int. Cl.
*E05C 1/08* (2006.01)
*E05C 1/12* (2006.01)

(52) U.S. Cl. ..... 292/163; 292/173; 292/DIG. 15

(58) Field of Classification Search ..... 292/DIG. 21, 292/163, DIG. 15, 137, 173, 143, 150, 340, 292/341.12, 332; 16/82
See application file for complete search history.

(56) References Cited

U.S. PATENT DOCUMENTS 595,505 A * 12/1897 Wesling ..... 292/167
788,950 A * 5/1905 Sargent ..... 292/178
903,409 A * 11/1908 Schneider ..... 292/175
908,252 A * 12/1908 Hall ..... 292/173
1,005,849 A * 10/1911 Lange et al. ..... 292/61
1,015,424 A * 1/1912 Cline ..... 292/178
1,179,606 A * 4/1916 Bull et al. ..... 292/193
1,225,285 A * 5/1917 Swaim ..... 292/175
2,726,109 A * 12/1955 Bennett ..... 292/167
3,024,056 A * 3/1962 Cook ..... 292/177
3,183,027 A * 5/1965 Powers ..... 292/40
4,099,753 A * 7/1978 Gwozdz et al. ..... 292/177
4,315,647 A * 2/1982 Wilzig et al. ..... 292/143
5,004,277 A * 4/1991 Campbell et al. ..... 292/166
5,350,207 A * 9/1994 Sanders ..... 292/335

* cited by examiner

*Primary Examiner*—Patricia L Engle
*Assistant Examiner*—Alyson M Merlino
(74) *Attorney, Agent, or Firm*—Klaus J. Bach

(57) ABSTRACT

In a door panel with an integrated door stopper disposed in a door rabbet wherein the door stopper comprises a stopper bolt movably disposed in the rabbet and a compression spring for biasing the door stopper in frictional contact with an underlying floor and an operating mechanism disposed in the door panel and including an operating member movable between two rest positions and connected to the stopper bolt for moving the stopper bolt out of contact with the under laying floor against the force of the compression spring, the operating structure for the stopper bolt extends from a housing accommodating the operating structure in such a way that no space is needed adjacent the side walls of the housing.

1 Claim, 8 Drawing Sheets

DOOR WITH INTEGRATED STOPPER

BACKGROUND OF THE INVENTION

The invention relates to a door with a stopper integrated into the door by which the door can be held in an open position.

Known door stoppers as they are generally used are mounted to the door panel and actuated by a foot. They often include a ratchet or bolt clamping mechanism by which a door stopper bolt when pressed downwardly by a foot is held firmly in contact with the underlying floor and a release lever which is also preferably operated by a foot for releasing the stopper bolt so that it can be moved upwardly by a spring out of engagement with the floor. Known door stoppers are therefore robust and correspondingly large and heavy. They are visually unattractive and are used therefore mostly in connection with house doors, but rarely indoors in connection with the room doors or patio and balcony doors of apartments or residential homes.

However, there is a need for door stoppers for doors in residential homes because it is often desirable to hold the doors partially or fully open for example for airing the rooms in a way which ensures that the door is not rapidly opened or closed by wind or drafts in such a way that damages occur by the door or door handle hitting for example furniture pieces or an adjacent wall causing possibly glass in the door to break or the furniture or walls to be damaged. Because of the unattractive appearance of the door stoppers in connection with interior doors, there is no demand for such door stoppers and they are therefore also not available for use in connection with interior doors, and consequently other unattractive and cumbersome devices such as wedges or cords or chains are used to hold the doors in open or partially open positions which devices however generally do not really lock the door in a position but prevent it only from closing, that is, they do not permit locking a door in a partially open position.

It has already been tried to integrate door stoppers into door panels. The German GM 1780520 from 1958, for example, discloses a door stopper which is to be integrated into a rabbet area of a door panel and coupled with the door handle. This door stopper includes a door stopper bolt which is provided with an engagement rubber structure and is biased downwardly by a compression spring. It is coupled via an operating linkage disposed in a door rabbet with a lever arranged at the outside of the lock housing and connected to the square shaft of the door handle. When the door handle is pressed downwardly, the door stopper bolt is moved upwardly against the spring force so that the door can be moved. Upon releasing the door handle, the spring-loaded door stopper is moved down and arrests the door in its momentary position. However, this known proposed structure is not usable in practice for several reasons: For one, already the arrangement of the linkage and the lever connected to the square shaft on the outside of the lock housing is not practical since then a free space must remain next to the lock housing in the door panel so that the lock housing is not firmly engaged within the door panel as it is the case in the normal arrangement in which the lock housing is inserted into an opening cut into the door panel so as to tightly accommodate the lock housing. On the other hand, the arrangement is highly annoying as the door can be moved only when the door handle is pressed down which is awkward under normal conditions and therefore not acceptable.

Another proposal of a door panel-integrated door stopper which is also impractical is known from the German Utility Model 1 805 041, wherein again a door stopper bolt provided with a braking rubber is biased downwardly by a compression spring and includes a linkage which is disposed in a door rabbet and provided at its top end with a lever fork extending at opposite sides of the lock housing. When the door handle is pressed down, the door stopper bolt is raised via the linkage by means of a lifting lever which is connected to the square shaft of the door handle and a spring-loaded locking finger engages the raised lifting lever so that the door stopper bolt remains in the raised position and the door can be moved. For releasing the door stopper, the door handle must be moved upwardly whereby the locking finger is moved out of engagement with the lift fork. The arrangement however is such that already a slight unintentional lifting of the door handle results in the release of the door stopper resulting in an unwanted blocking of the door. The main problem however is the arrangement of the operating mechanism in a space at both sides of the lock housing which is not available in a standard door so that a thicker door panel is needed. In addition, the space needed at opposite sides of the lock housing in its accommodation opening in the door panel for receiving the door stop mechanism results in an unstable engagement of the lock housing in the door panel.

Further, an arrangement known from DE 1 968 078, wherein a door stopper which is pre-tensioned by a compression spring in a release direction, can be pressed downwardly by way of a cam lever by upward movement of the door lever, which however does not appear to be a solution which is compatible with the common door locks.

Finally, DE 1 947 291 discloses an arrangement wherein a door stopper bolt which is biased downwardly by a compression spring is connected by way of a steel cable to a lever which again is arranged on the side of a lock housing and which is operable by the door handle.

All these arrangements do not fulfill the requirements of a normal door lock housing which has a standard size so that it can be accommodated in a standard opening for firm engagement therein. They require additional cut outs in the door for which special tools and time are needed and which weaken the support and engagement of the door lock housing in the door.

It is therefore not surprising that those arrangements have not found acceptance in praxis.

It is the object of the present invention to provide a door stopper which can easily be integrated into a door even as a back-fitting, which is easy to operate, which is practically invisible and which permits the use of the commercially available lock housings and hardware.

SUMMARY OF THE INVENTION

In a door panel with an integrated door stopper disposed in a door rabbet wherein the door stopper comprises a stopper bolt movably disposed in the rabbet and a compression spring for biasing the door stopper in frictional contact with an underlying floor and an operating mechanism disposed in the door panel and including an operating member movable between two rest positions and connected to the stopper bolt for moving the stopper bolt out of contact with the under laying floor against the force of the compression spring, the operating structure for the stopper bolt extends from a housing accommodating the operating structure in such a way that no space is needed adjacent the side walls of the housing.

The door stopper and its operating mechanism can be integrated into a door panel in such a way that it is invisible from either side of the door panel and therefore does not detrimentally affect the appearance of the door. It permits the door to be held in any desired position, that is, also in a partially open position independently of the unevenness in the underlying floor area.

The door stopper according to the invention is in the form of a door edge stopper integrated into the door rabbet and is operable in a way similar to the known door edge locking bolts which are installed into the door rabbet near the top or the bottom of the door and includes a rigid locking bolt which is operable by a pivot lever for insertion into an opening in the floor or in the door frame in order to lock the door in its closed position. The door edge stopper according to the invention may be inserted, fully assembled in a housing, into a corresponding cut-out in the door rabbet.

For more convenient operation, the operating lever may be arranged relatively far upwardly for example directly below the door lock housing so that the operator does not need to bend down for reaching the operating lever. For connection to the doorstopper bolt, a door stopper housing which includes both the operating lever and the door stopper and also a connecting structure, may be inserted into a corresponding cavity in the door rabbet or the operating unit and the door stopper unit may be separately installed in the door rabbet and interconnected by a connecting member extending through a passage in the door panel or the door rabbet.

The door stopper according to the invention may also assume the function of a conventional door edge lock by entering in the closed position of the door into a floor opening or a sleeve disposed in the floor.

Below advantageous embodiments of the invention will be described with reference to the accompanying drawings.

DESCRIPTION OF PARTICULAR EMBODIMENTS

Figure 1:
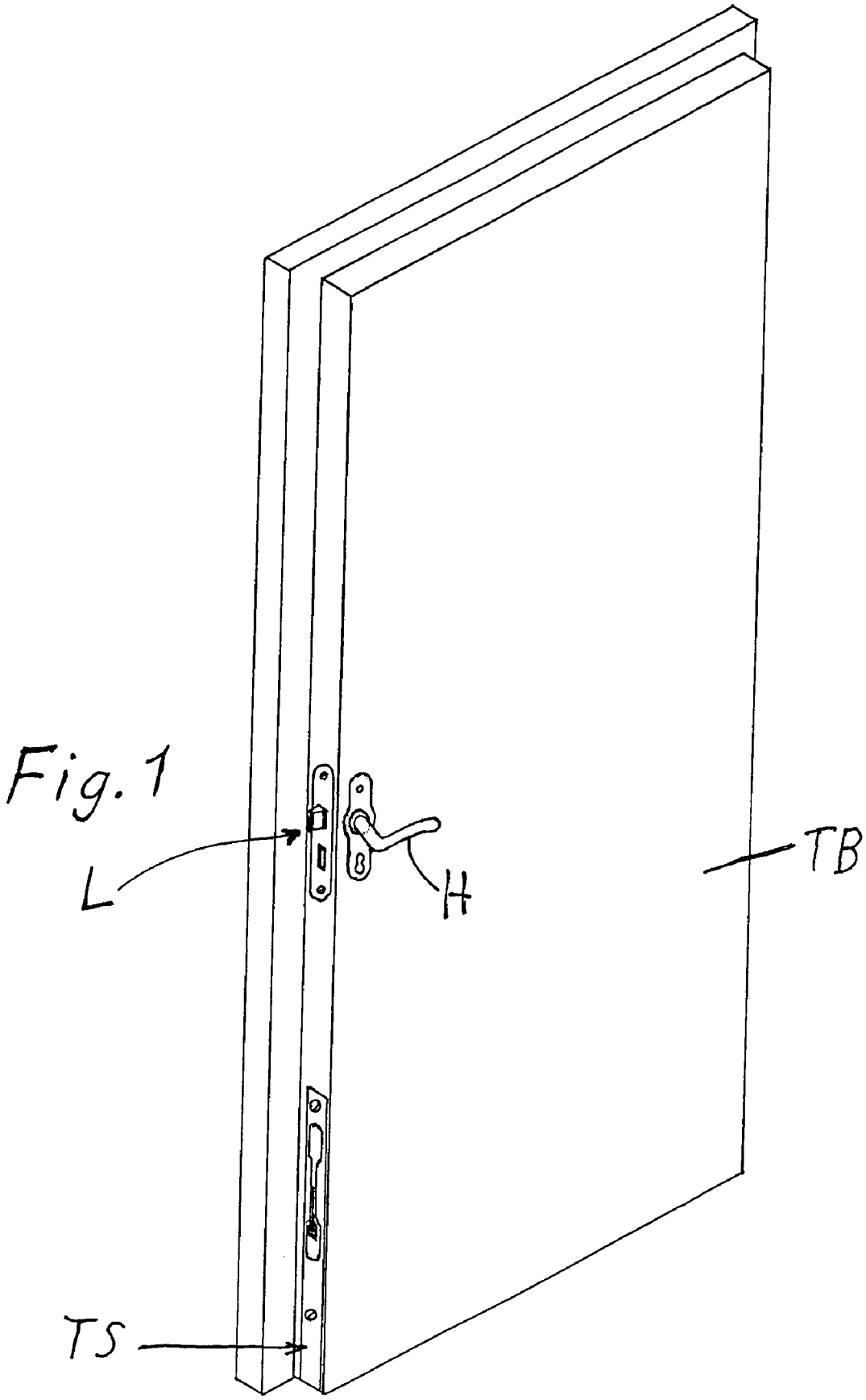
FIG. 1 is a perspective view of a door panel including a door stopper according to the invention of the type according to FIGS. 2 to 4, FIGS. 2-4 show a first embodiment of a door stopper unit with spring compression actuation of the stopper bolt.

FIG. 1 shows generally the installation of a door stopper in a door panel "in a perspective view", wherein on the door panel TB only the door handle H and the outer door stopper operating hardware are visible. At the door front edge, the door lock L is visible adjacent the door handle H and near the lower end of the door, a door stopper TS is installed in the door panel of which however only the cover with the operating lever 6 is visible representing the embodiment of FIGS. 2-4. The door stopper as such is completely out of sight, particularly nothing at all is visible of the door stopper on the sides of the door panel.

Figure 2:
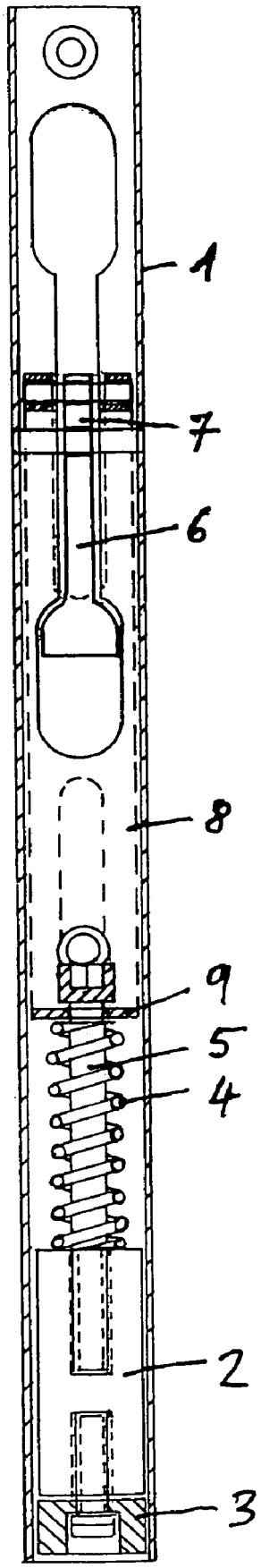
Figure 3:
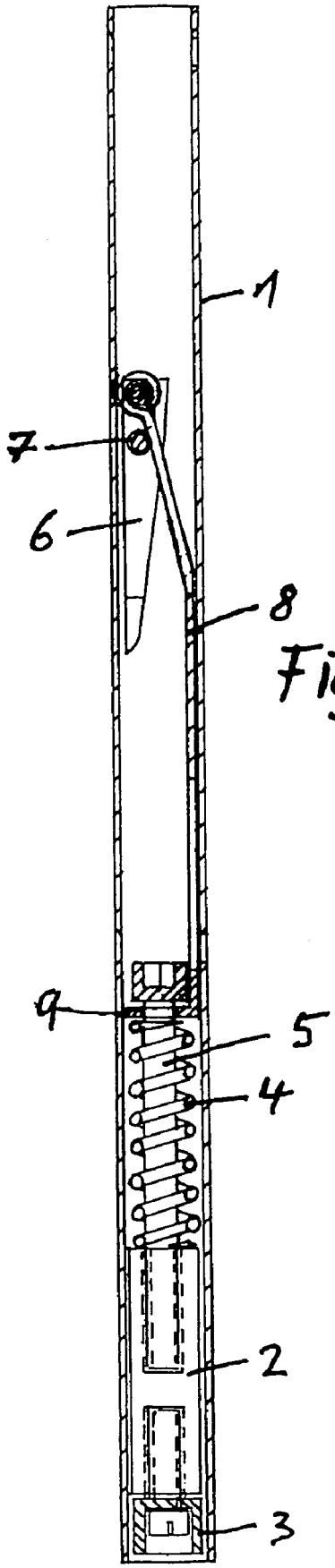
Figure 4:
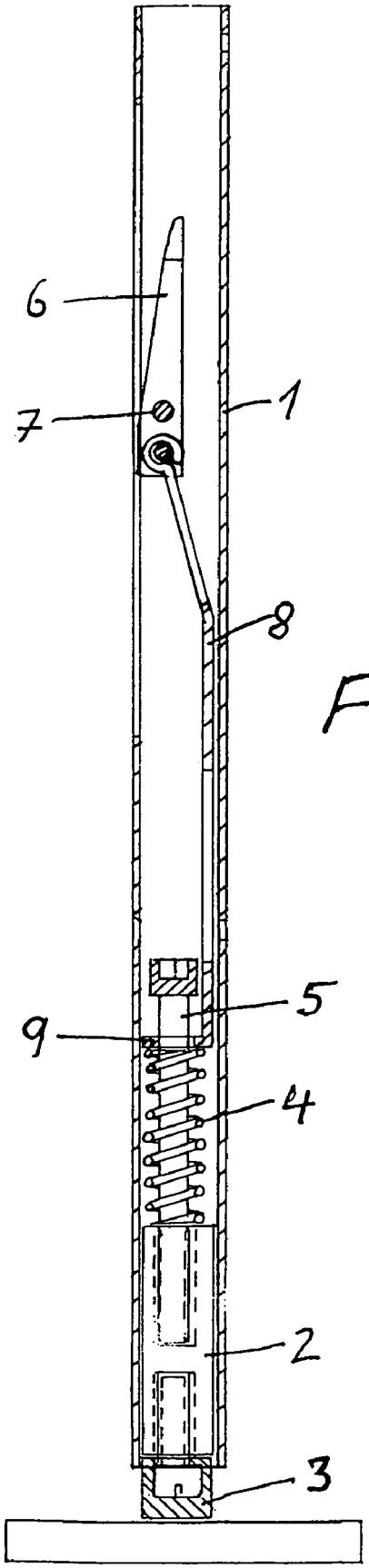

The FIGS. 2 to 4 show a first embodiment of the door stopper each in a cross-sectional view so that the operating mechanism is clearly visible. FIG. 2 shows the door stopper in a view toward the door rabbet locking at the cover of the operating structure installed into the door rabbet. FIGS. 3 and 4 show the door stopper in side views, the FIGS. 2 and 3 showing the stopper bolt in a release position while FIG. 4 shows it in a door stop position pressed onto the floor.

The door stopper includes a housing 1 of sheet metal, a stopper bolt 2, a stopper foot 3 of a high friction material such as rubber, a compression spring 4 and a bolt screw 5. The stopper foot 3 is screwed from the bottom into the stopper bolt whereby its position may be adjustable. The bolt screw 5 is screwed into the bolt from the top so as to be also adjustable. The head of the bolt screw 5 also serves as stop for engaging the actuating structure for lifting and holding the bolt 2 in the release position of the door stopper. A double arm operating lever 6 is pivotally supported about an axis 7. Its longer lever arm forms the operating structure and its shorter lever arm is connected to the upper end of a flat strip 8 whose bottom end is bent over and forms a disc or washer 9 providing an abutment for the compression spring 4, which, with its bottom end, abuts the stopper bolt 2.

FIG. 3 shows the door stopper in the release position, wherein the operating lever 6 is pivoted downwardly so that the pivot joint between the strip 8 and the operating lever 6 is disposed above the axis 7 and the disc 9 engages the head of the bolt 5 and holds the bolt 2 with the bolt foot 3 in the raised release position. In FIG. 4, the operating lever 6 is shown pivoted upwardly so that the strip 8 is biased downwardly whereby the bolt 2 with the bolt leg is moved downwardly into contact with the floor below. The strip 8 with the disc 9 compresses the spring 4 to a certain extent for providing a certain engagement force between the stopper bolt foot 3 and the floor. The arrangements is such that there is a certain play between the compressed spring 4 and the head of the bolt 5 when the bolt foot is seated on the floor in order to be able to accommodate unevenness of the floor in the range of movement of the door. The compression spring 9 is tensioned even in the release position of the door stopper bolt.

In the embodiment as shown in FIGS. 2 to 4, the spring 4 biases the stopper bolt downwardly and the foot 3 into engagement with the floor. It would of course also be possible to mount the bolt foot 3 so that it is movable relative to the bolt 2 over a certain distance, for example, in a telescope fashion and to arrange a compression spring between the bolt foot 3 and the bolt 2. The flat strip 8 could then be firmly connected to the bolt 2.

Figure 6:
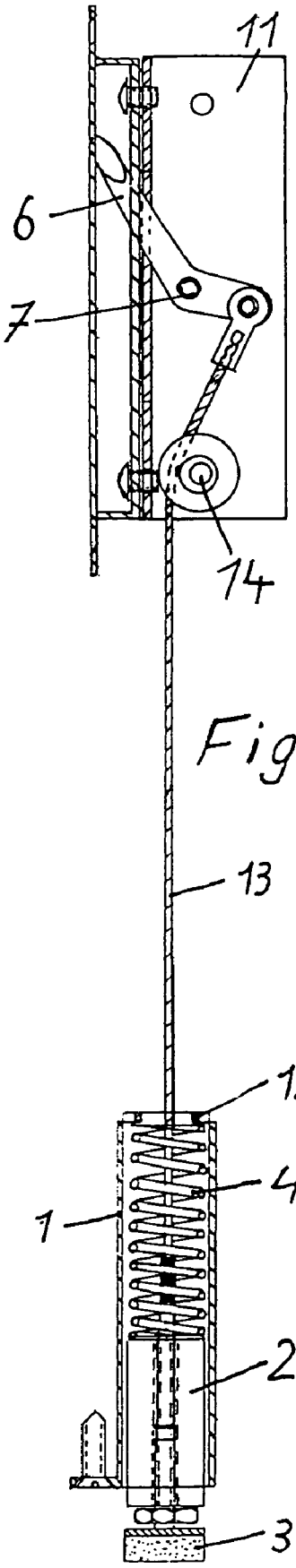
FIGS. 5-7 show a second embodiment including a pull cable operation for the stopper bolt.
Figure 7:
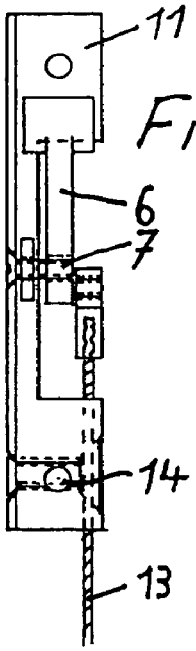
Figure 5:
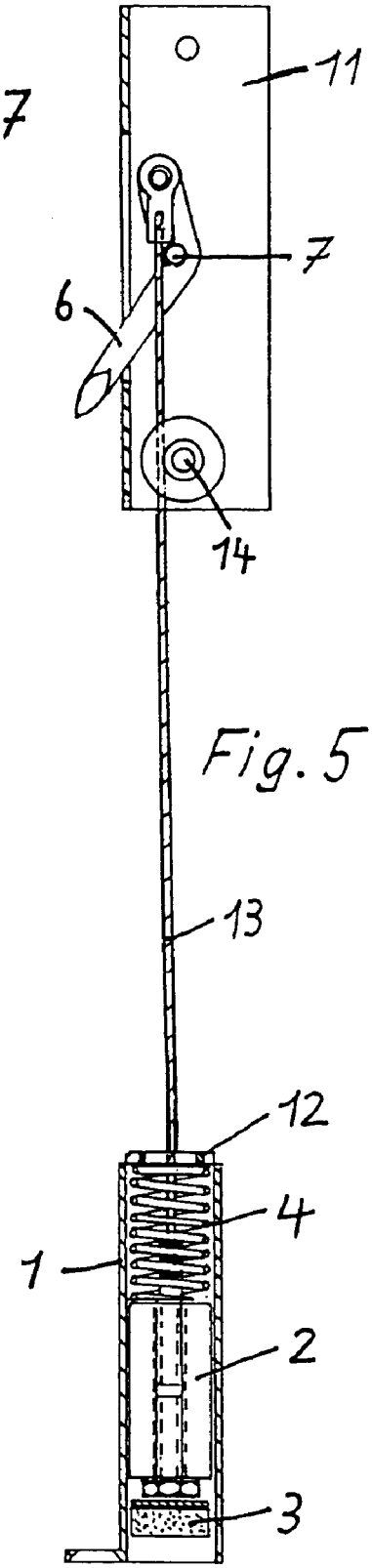

FIGS. 5-7 show another embodiment of the door stopper according to the invention wherein FIG. 5 is a side view showing the stopper bolt 2 in a rest position in which the stopper bolt 2 is raised; FIG. 6 is a side view showing the stopper bolt in the operating position in which the stopper bolt is lowered and FIG. 7 shows the actuating range of the operating lever 6.

Again the door stopper comprises a housing 1, a door stopper bolt 2 with a bolt foot 3, a compression spring 4 and an operating lever 6 which is supported so as to be pivotable about an axis 7. The housing however encloses only the stopper bolt 2 and the compression spring 4, whereas the operating lever is (not necessarily) disposed in a separate housing 11, which is arranged at a distance from the stopper bolt housing, for example, directly below the door lock housing in the door panel, that is, in a location which is more convenient for an operator.

The compression spring 4, which acts on the top of the bolt 2, abuts with its upper end a cover disc or rim 12 of the housing 1. The bolt 2 is connected to the short arm of the operating lever 6 by a pull member, for example, in the form of a steel cable 13. In the embodiment shown, the steel cable 13 is guided in the lower part of the housing 11 by a guide roller 14 (or a guide bolt) so that the pull member 13, or respectively, steel cable is always oriented in the same direction between the bolt 2 and the guide roller 14.

FIG. 5 shows the release position wherein the operating lever 6 is pivoted downwardly so that the pull member is pulled upwardly and the bolt 2 is in a raised position while the compression spring 4 is compressed. In this position, the axis of the pull member 13 extends at the left side (as shown in FIG. 5) of the lever axis 7 so that the operating lever 16 is arrested in this position by the tension force of the pull member 13 generated by the compression spring 4. FIG. 6 shows the structure in the operating position, in which the operating lever 6 is pivoted upwardly whereby the pull member 13 is lowered and the compression spring 4 presses the bolt 2 downwardly against the floor. As apparent from FIG. 6, the operating lever 6 is also in this position fixed by the pulling force of the pull member 13. The compression spring 4 is so sized that it provides sufficient engagement force for the bolt foot 3 so that the bolt foot 3 frictionally engages the floor and the door is arrested in a particular selected position.

Figure 8:
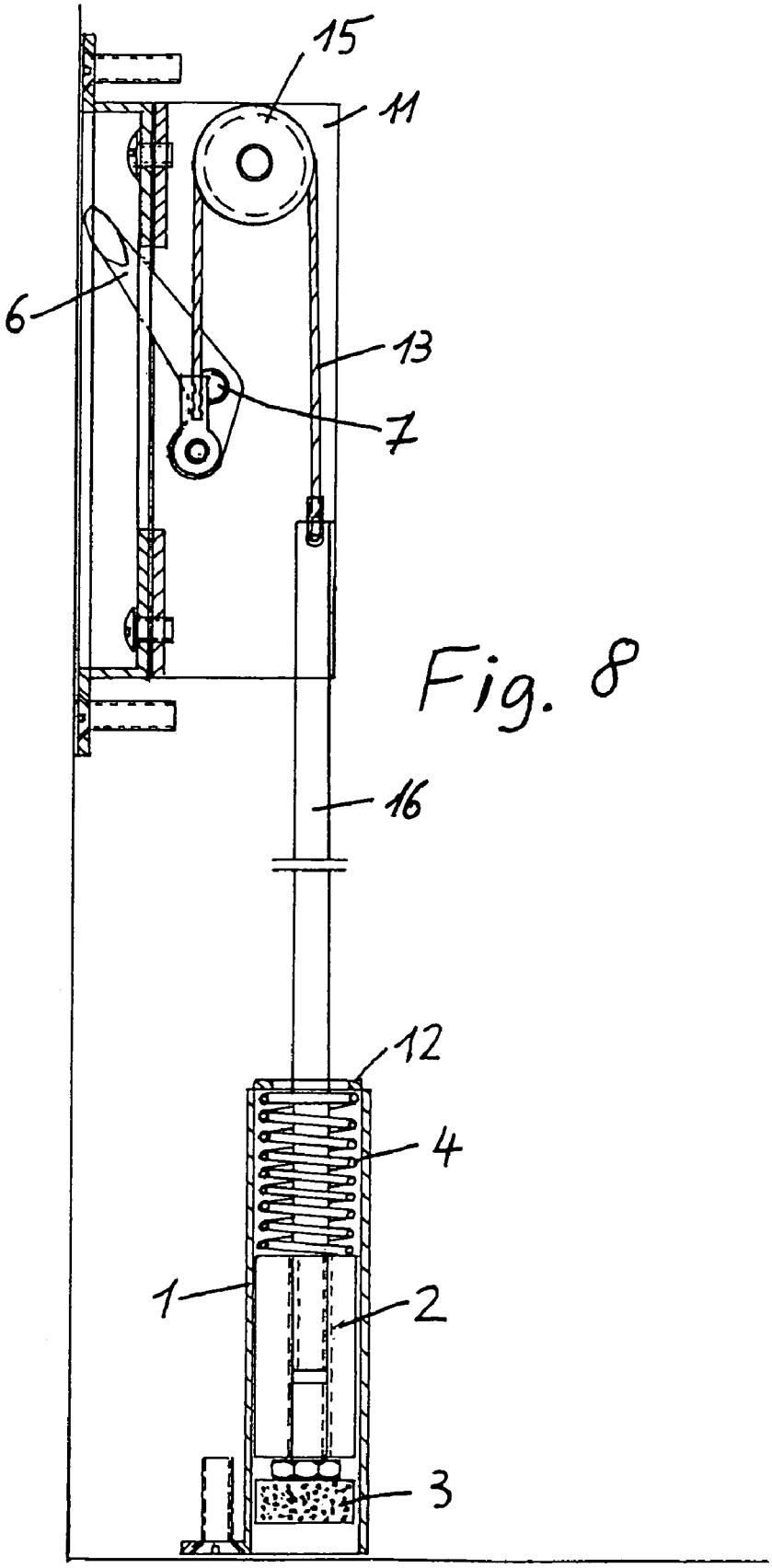
FIG. 8 shows a modification of the pull cable operating structure for the stopper bolt.

The embodiment of FIG. 8 is similar to that of FIGS. 5-7, but in this case the pull member 13 extends around a reversing roller 15 before it is connected to the operating lever 6. The arrangement operates like that of FIG. 5 except that in the release position when the bolt with the foot 3 is raised also the operating lever is tilted upwardly, that is, the bolt 2 with the foot 3 is moved in the same direction as the operating lever 6.

FIG. 8 also shows that the pull member is connected to the stopper bolt 2 via a hinge or, respectively, a rod 16 and only the upper part of the pull member is a steel cable or a similar drive structure.

Figure 9:
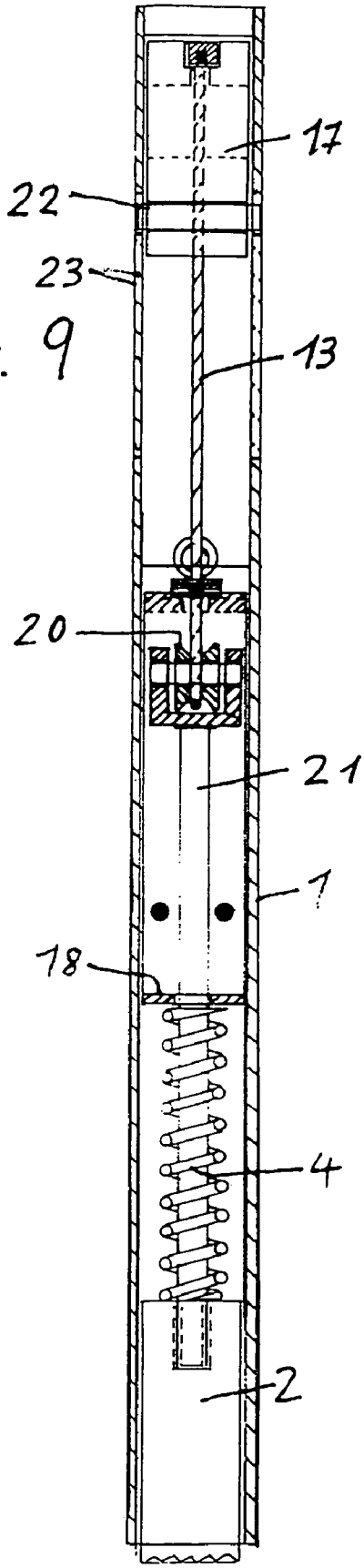
FIGS. 9-11 show another embodiment of the door stopper with a cable operation of a compression spring for locking the door.
Figure 10:
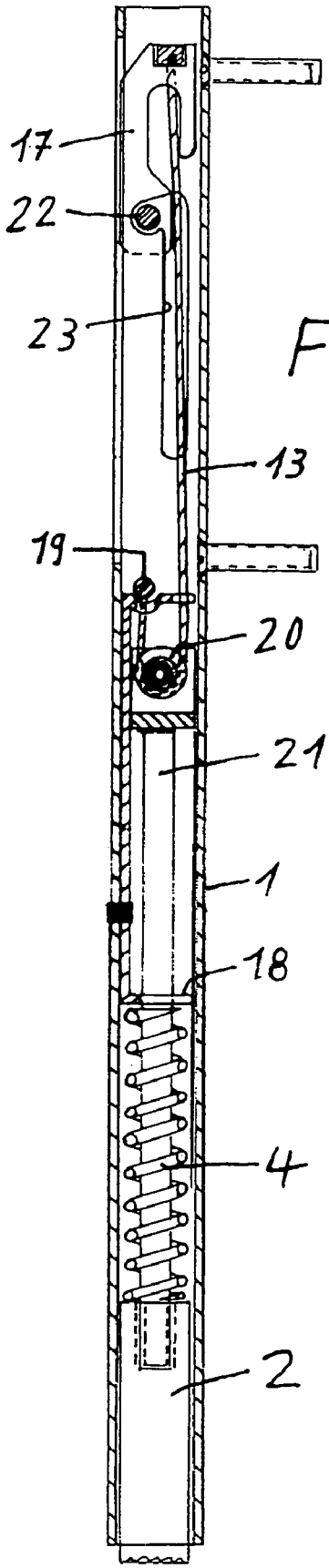
Figure 11:
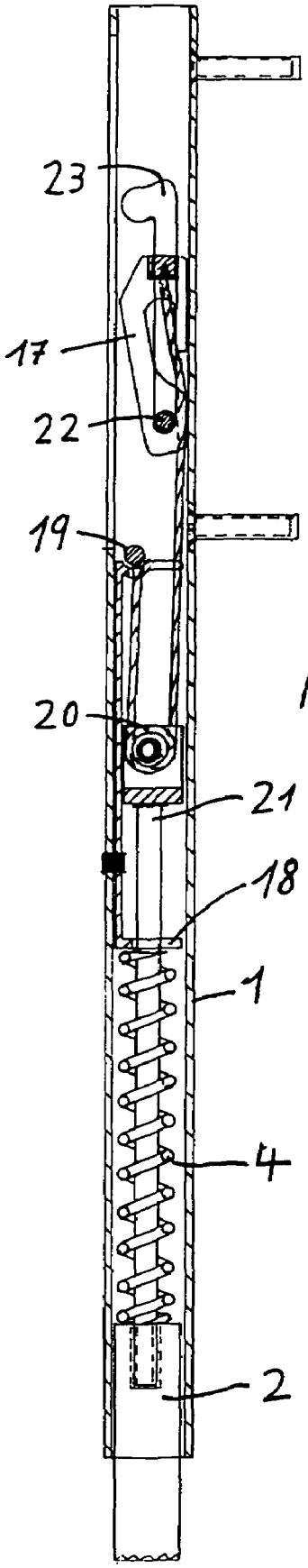

FIGS. 9-11 show another embodiment wherein also a pull cable is used, however instead of an operating lever an operating slide 17 is provided and, for actuating the stopper bolt 2 a hoist principle is used.

Again, a housing 1 is provided, in which the movable door stopper 2 with the stopper foot 3 and a compression spring 4 are arranged. The compression spring 4 is supported at the top on a support structure 18, which is mounted in the housing while the lower end of the compression spring 4 is seated on the stopper bolt 2. A pull member 13 for example in the form of a steel cable is held at one end of a fixed point 19 in the housing 1 and extends from there first downwardly and then around a reversing roller 20 which is supported on a shaft 21, that is, mounted on the shaft 21. From the reversing roller 20, the pull member or steel cable extends upwardly and is attached to an operating slide 17. The operating slide 17 is provided in its lower end area with a transverse bolt 22 projecting from the operating slide 17 in opposite directions into guide slots 23 formed in the housing 1. At their upper ends, the guide slots have forwardly and downwardly extending extensions into which the transverse bolt 22 can be moved in the upper most position of the slide 17 (FIG. 10) so that the transverse bolt 22 is held in this position by the spring-biased pull member 13. The stopper bolt 2 is then in a release or rest position in which it is removed from the floor below so that the door is freely movable.

In order to bring the door stopper into its operating position, the slide is simply pressed inwardly with the thumb whereby the bolt 22 is moved back and slightly upwardly out of the sideward extension of the slot 23 into the vertical part of the slot so that the slide 17 can move downwardly whereby the reversing roller 19 with the shaft 21 and the stopper bolt can move downwardly until the stopper bolt foot 3 is seated on the floor below with a force generated by the compression spring 4. In order to return the door stopper again to its rest or release position, the slide 17 is again moved upwardly by hand until the transverse bolt 22 is again received in the sideward extension of the guide slot 23. Since in this embodiment, the hoist principle is used as the pull member extends around the reversing roller 19 mounted to the stopper bolt 2 only half the force is needed for raising the bolt although the slide member travel distance is doubled.

In the embodiment shown herein the housing 1 accommodates the stopper bolt 2 as well as the slide member 17. It is noted that the stopper bolt 2 and the slide member 17 may be arranged at larger distance from one another and that they may also be arranged in separate housings so that the slide member is at a location which is convenient for an operator that is in a position in which the operator does not need to bend down.

Figure 12:
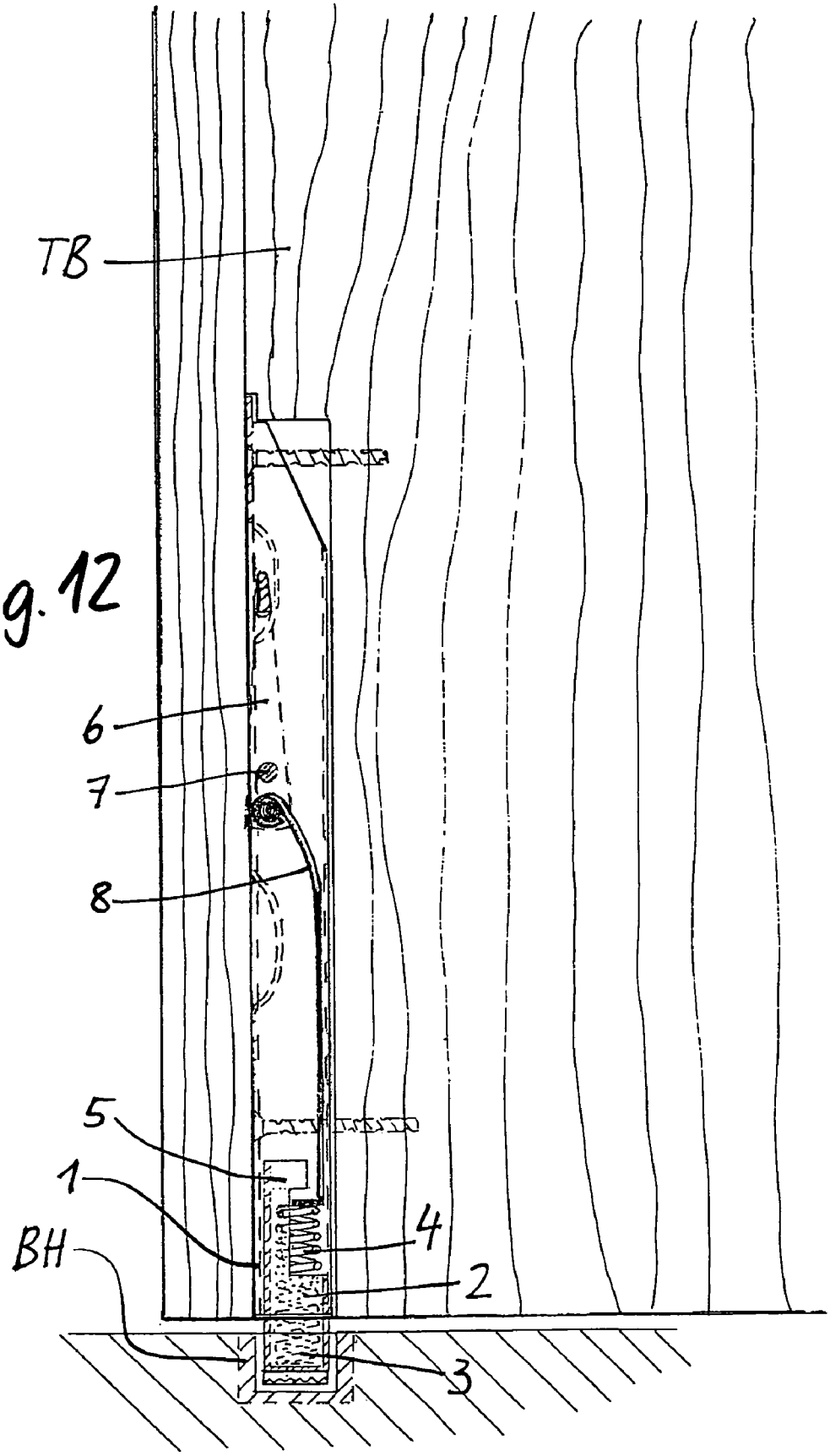
FIG. 12 shows the use of a door stopper also for bolt-locking a door in a closed position.

FIG. 12 is a cross-sectional view of the front area of a door panel with a door stopper according to the invention which may also serve as a door lock mounted in the door panel. In the floor, a tube sleeve BH is installed which provides an opening into which the bolt foot 3 of a door stopper in accordance with the embodiment shown in FIGS. 2 to 4 projects in its lowered position. The door stopper according to the invention consequently can also take on the form of a conventional door lock and door with conventional door locks can be converted simply by exchanging the conventional door lock for a door stopper according to the invention. Of course, the door stopper bolt must be movable over a sufficient travel distance so that it can be moved between a raised position in which the bolt stopper foot 3 is retracted from the floor sleeve BH and raised from the floor so that the door is freely movable and again moved by a compression spring back into its operating position in which the stopper bolt foot enters-when the door is closed-into the floor sleeve BH or when the door is at least partially open-the stopper bolt foot 3 is pressed into frictional contact with the floor so that the door is firmly held in a particular desired position.

What is claimed is:

1. A door comprising a door panel with an integrated door stopper installed in a cut-out in the door panel, said door stopper comprising a door stopper bolt with a foot movably disposed in a housing installed in the cutout, a compression spring for biasing the door stopper bolt downwardly in frictional contact with an underlying floor, and an operating mechanism comprising a lever disposed in the housing so as to be movable between two stable positions, and a rigid connecting element with a spring support member disposed at its end extending between the lever and the door stopper bolt by way of which the door stopper bolt is capable of being held with its foot raised out of contact with the underlying floor in one of the stable positions of the lever or held with a contact force of the compression spring in contact with the underlying floor in the other of the stable positions of the lever, said compression spring being disposed between the spring support member of the connecting element and the door stopper bolt, the door stopper bolt comprising a body attached to the foot at one end and attached at the other end to an upwardly extending shaft provided with a head and the compression spring extending around the upwardly extending shaft and being seated with one end on the door stopper bolt and engaging with its other end the spring support member in a precompressed state, the rigid connecting element with the spring support member being movable along the shaft for compressing the spring and biasing the door stopper in contact with the underlying floor with the force of the compressed compression spring.

* * * * *